US005606961A

United States Patent [19]

Basik et al.

[11] Patent Number: 5,606,961

[45] Date of Patent: Mar. 4, 1997

[54] ARROW REST ASSEMBLY

[76] Inventors: Ronald Basik, 5885 N. Elston Ave., Chicago, Ill. 60646; Richard Colvin, 1948 Connors Rd., Baldwinsville, N.Y. 13027

[21] Appl. No.: 326,537

[22] Filed: Oct. 20, 1994

(Under 37 CFR 1.47)

[51] Int. Cl.[6] ..... F41B 5/22

[52] U.S. Cl. ..... 124/44.5

[58] Field of Search ..... 124/24.1, 25.6, 124/44.5, 86, 88

[56] References Cited

U.S. PATENT DOCUMENTS

| | | | |
|---|---|---|---|
| 2,743,716 | 5/1956 | Wendt | 124/44.5 |
| 2,777,435 | 1/1957 | Brooks | 124/44.5 X |
| 3,059,631 | 10/1962 | Yasho | 124/44.5 |
| 4,038,960 | 8/1977 | Ludwig | 124/44.5 |
| 4,453,528 | 6/1984 | Eckert | 124/44.5 |
| 4,865,007 | 9/1989 | Saunders | 124/44.5 |
| 5,009,215 | 4/1991 | Ludwig | 124/44.5 |
| 5,311,855 | 5/1994 | Basik | 124/44.5 |
| 5,365,912 | 11/1994 | Pittman | 124/44.5 |
| 5,372,119 | 12/1994 | Kidney | 124/44.5 |

*Primary Examiner*—John A. Ricci

*Attorney, Agent, or Firm*—Marshall, O'Toole, Gerstein, Murray & Borun

[57] ABSTRACT

In order to ensure rapid and effective arrow shaft positioning, without interfering with intended flight trajectory, an arrow rest assembly includes a support for an arrow in proximity to a handle riser portion of a bow. The arrow support includes a body member disposed in a plane generally parallel to a plane defined by the bow and a bowstring on the bow. The body member has a surface for supporting a shaft of the arrow. It also is mounted to the handle riser portion of the bow. The body member has a pivot point spaced from the shaft supporting surface. The mounting is associated with the body member at the pivot point. With this arrangement the arrow rest assembly is such that the mounting accommodates pivotal movement of the body member within the plane of the body member about the pivot point from an arrow supporting position to an arrow passage position.

27 Claims, 4 Drawing Sheets

ARROW REST ASSEMBLY

FIELD OF THE INVENTION

The present invention is generally directed to the field of archery and, more particularly, an arrow rest assembly for a bow handle riser.

BACKGROUND OF THE INVENTION

In recent years, there have been many attempts to provide a disappearing arrow rest assembly that does not interfere with the flight of the arrow through the bow. It is important in this respect for any such arrow rest assembly to entirely eliminate any mechanical interference between a shaft supporting component of the rest and the arrow and/or fletching of the arrow. Unfortunately, it has typically been the case that such arrow rest assemblies have been less than entirely satisfactory.

In this connection, many of the earlier attempts at arrow rests have not eliminated interference. It has also been the case that most, if not all, of prior art arrow rest assemblies have been relatively expensive to manufacture and/or are subject to damage. Moreover, the interference with arrow flight is a known cause of arrow wobble and poor shooting accuracy.

As for other problems, there has more recently been developed the utilization of injection molded fletching.

With such modern fletching, it is essential that there be no contact during firing of an arrow with the arrow rest assembly. This is even important when the fletching comprises more conventional materials such as feathers or the like, inasmuch as any fletching is highly susceptible to damage by reason of the high forces encountered, and, unquestionably, the contact of the fletching with the arrow rest assembly is highly detrimental to accurate arrow flight. For all of these reasons, there has been a need for an entirely satisfactory arrow rest assembly for archery enthusiasts.

As previously suggested, the principal requirements for any arrow rest assembly are to ensure rapid and effective arrow shaft positioning, proper arrow shaft support and guidance, and the ability to "disappear" or "fall away" so as to avoid any interference or contact with the arrow or fletching after firing the arrow.

The present invention is directed to overcoming one or more of the foregoing problems and achieving one or more of the resulting objects.

SUMMARY OF THE INVENTION

It is a principal object of the present invention to provide an improved arrow rest assembly that has a minimum of moving parts and is highly effective for its intended purpose. It is a further object of the present invention to provide an arrow rest assembly that avoids any interference with an arrow or fletching on an arrow after the arrow has been fired. It is an additional object of the present invention to provide an arrow rest assembly that is inexpensive to manufacture and not susceptible to damage.

Accordingly, the present invention is directed to an arrow rest assembly having means for supporting an arrow in proximity to a handle riser portion of a bow. The arrow supporting means includes a body member disposed in a plane generally parallel to a plane defined by the bow and a bowstring on the bow. The body member has a surface for supporting a shaft of the arrow. The arrow rest assembly also includes means for mounting the body member to the handle riser portion of the bow. The body member has a pivot point spaced from the shaft supporting surface. The mounting means is associated with the body member at the pivot point so as to accommodate pivotal movement of the body member. More specifically, the arrow rest assembly is such that the mounting means accommodates pivotal movement of the body member about the pivot point from an arrow supporting position to an arrow passage position.

In a highly preferred embodiment, the body member is generally V-shaped and in the form of a segment of a circle. The pivot point for the body member is then advantageously positioned generally at the center of the circle segment. Preferably, the arrow shaft supporting surface is positioned generally at the circle segment periphery.

In addition to the foregoing, the body member is preferably formed of a resilient rubber-like material. The arrow shaft supporting surface is then advantageously generally arcuate and convex for frictional engagement with opposite sides of the shaft of the arrow. With this arrangement, the body member undergoes pivotal movement when the arrow is propelled by the bowstring.

In addition, the body member preferably has a leading edge that is generally vertically upwardly extending when the bow is supported in a generally vertical position. With this configuration, the shaft of the arrow is adapted to contact the arrow shaft supporting surface at a point generally adjacent the leading edge of the body member.

As for the mounting means, it preferably includes an axial spacer arm having a first end to be secured to the handle riser portion of the bow and a second end remote therefrom. Still additionally, the body member is advantageously mounted for pivotal movement on an axial spacer shaft supported by the second end of the axial spacer arm so as to extend perpendicular thereto.

In a highly preferred embodiment, the body member is mounted on an end of the axial spacer shaft so as to be in spaced relation to the axial spacer arm. It is also advantageous for the arrow rest assembly to include stop means for limiting pivotal movement of the body member. More specifically, the pivotal movement is preferably limited to movement between the arrow supporting position and the arrow passage position of the body member.

In one embodiment of the arrow rest assembly, means are provided for imparting over center snap action when the body member reaches a point generally intermediate the arrow supporting position and the arrow passage position as the body member undergoes pivotal movement about the pivot point. The over center snap action imparting means preferably includes a pair of pins extending parallel to but radially spaced from an axis of the axial spacer shaft, with one of the pins being fixed, and the other of the pins being movable with the body member on the axial spacer shaft. Additionally, the over center snap action imparting means advantageously includes a resilient band joining the pins which are located along a line on one side of the axis in the arrow supporting position and along a line on the other side of the axis in the arrow passage position.

As for other details, the arrow rest assembly preferably includes a plurality of holes in the first end of the axial spacer arm for receiving a fastener therethrough to secure the axial spacer arm to the handle riser portion of the bow in any of a plurality of different angles and distances from the bow. It is also advantageous for the second end of the axial spacer arm to have an opening for receiving and retaining a first end of the axial spacer shaft along with means for securing the first end of the axial spacer shaft therewithin. With this arrangement, the securing means preferably includes a diagonal slot in the axial spacer arm extending completely through to the opening, together with fastener means for compressing the slot to cause the axial spacer shaft to be retained within the opening.

In another embodiment, the body member includes resilient finger means in the form of a pair of fingers generally located at the leading edge for releasably gripping the arrow shaft when the arrow shaft is in frictional engagement with the convex arrow shaft supporting surface. In all embodiments, the stop means can advantageously include a pin and a pair of pin engagement surfaces in angularly spaced relation with one of the pin and pin engagement surfaces being fixed, and the other of the pin and pin engagement surfaces being movable with the body member on the axial spacer shaft.

In still another embodiment, the stop means includes an axial stop arm supported by the second end of the axial spacer arm to extend perpendicular thereto. The axial stop arm is disposed generally parallel to the axial spacer shaft and extends to a point where the body member in the arrow supporting position is in engagement therewith. Further, the stop means may include a pair of spring fingers extending generally perpendicularly from the axial stop arm for limiting pivotal movement by releasably gripping the body member at the arrow passage position thereof.

As previously suggested, the body member is generally V-shaped in the form of a segment of a circle having a forwardly facing surface and a rearwardly facing surface such that the pivot point for the body member is positioned generally at the center of the circle and the arrow shaft supporting surface is positioned generally at the periphery of the circle. With this arrangement, the stop means may further include magnetic means operatively associated with the axial stop arm and the forwardly facing surface of the body member for limiting pivotal movement by magnetically maintaining the body member in the arrow passage position after the body member has pivoted from the arrow supporting position. Similarly, the stop means may still further include magnetic means operatively associated with the axial stop arm and the rearwardly facing surface of the body member for limiting pivotal movement by magnetically maintaining the body member in the arrow supporting position until the body member is caused to pivot from the arrow supporting position.

In the last-mentioned embodiment, the second end of the axial spacer arm includes a shaft extending generally perpendicular thereto supporting a supplemental spacer arm in adjacent relation whereby the axial spacer shaft and the axial stop arm are supported by and extend perpendicular to the supplemental spacer arm in spaced parallel relation.

Other objects, advantages and features of the present invention will become apparent from a consideration of the following specification taken in conjunction with the accompanying drawings.

DETAILED DESCRIPTION OF THE PREFERRED EMBODIMENTS

Figure 2:
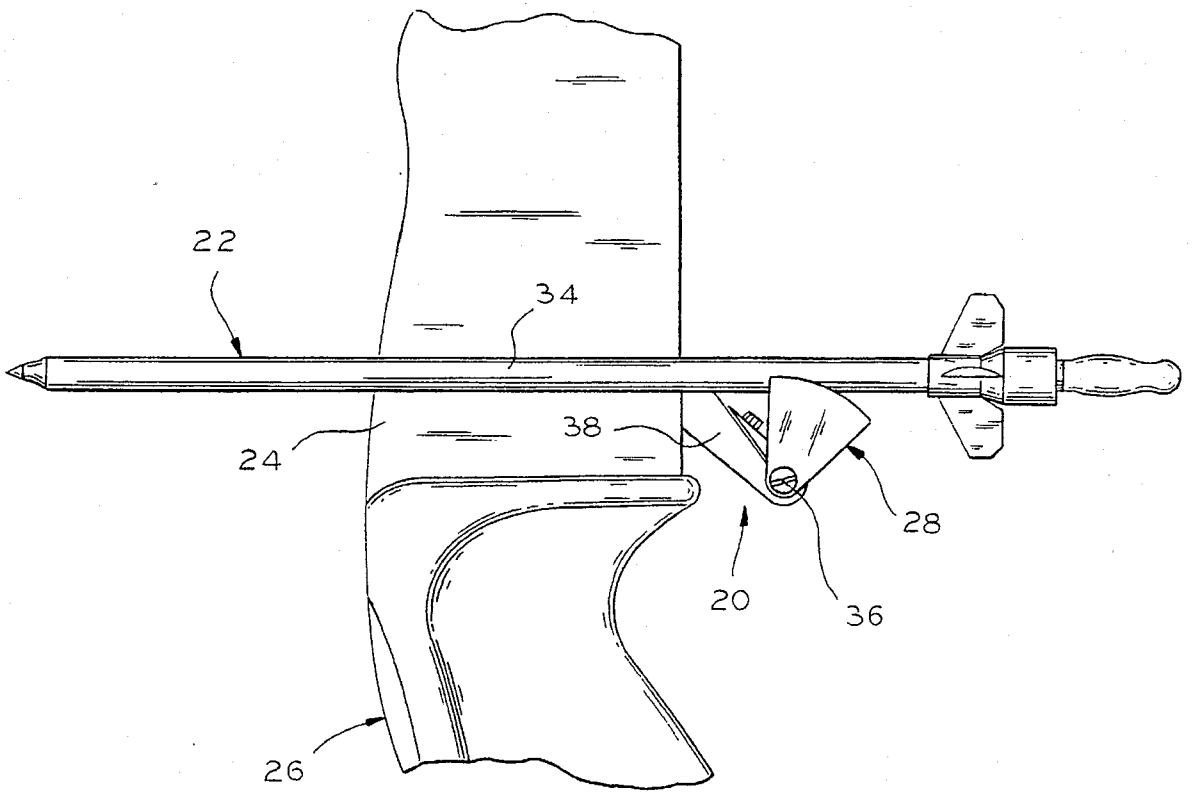
FIG. 2 is an enlarged side elevational view of the arrow rest assembly on the handle riser portion of the bow illustrated in FIG. 1.

In the illustrations given, and with reference first to FIGS. 1–6, the reference numeral 20 designates generally an arrow rest assembly in accordance with the present invention. The arrow rest assembly 20 includes means for supporting an arrow 22 in proximity to a handle riser portion 24 of a bow 26. The arrow supporting means includes a body member generally designated 28 which is disposed in a plane generally parallel to a plane defined by the bow 26 and a bowstring 30 on the bow 26. The body member has a surface 32 for supporting a shaft 34 of the arrow 22. Still additionally, the arrow rest assembly 20 includes means for mounting the body member 28 to the handle riser portion 24 of the bow 26.

Figure 4:
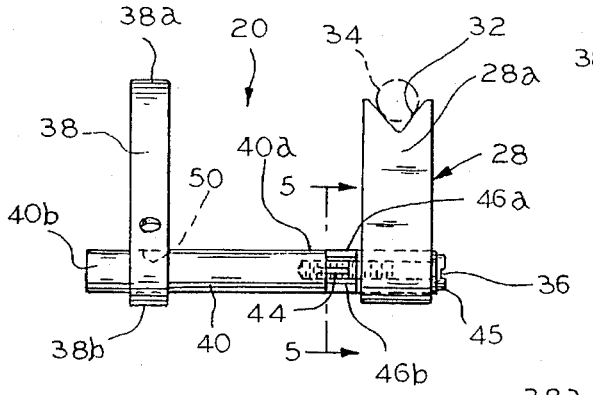
FIG. 4 is a front elevational view of the arrow rest assembly illustrated in FIG. 1.
Figure 3:
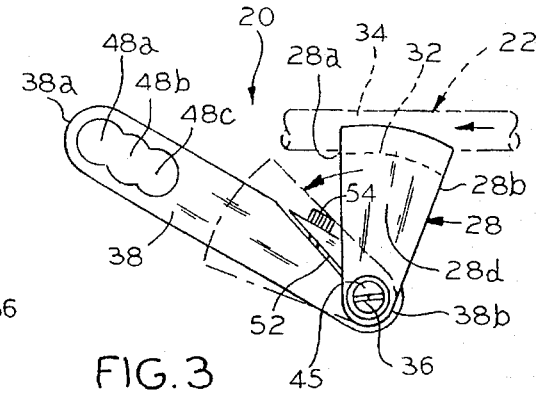
FIG. 3 is a side elevational view of the arrow rest assembly illustrated in FIG. 1.

Referring specifically to FIGS. 3 and 4, the mounting means will be understood to accommodate pivotal movement of the body member 28. The body member has a pivot point 36 spaced from the shaft supporting surface 32, and, as will be appreciated from FIG. 4, the mounting means is associated with the body member 28 at the pivot point 36 as will be apparent from the discussion below. As will also be appreciated, the mounting means accommodates pivotal movement of the body member 28 within the plane of the body member 28 and generally parallel to the plane defined by the bow 26 and the bowstring 30.

Still referring to FIGS. 3 and 4, the mounting means includes an axial spacer arm 38 having a first end 38*a* to be secured to the handle riser portion 24 of the bow 26 and a second end 38*b* remote therefrom. The body member 28 is mounted for pivotal movement on an axial spacer shaft 40, which also forms a portion of the mounting means, and which is supported by the second end 38*b* of the axial spacer arm 38 in such manner as to extend perpendicular thereto. With this arrangement, the body member 28 is adapted for pivotal movement about the axial spacer shaft 40 from an arrow supporting position (solid lines) to an arrow passage position (broken lines) as shown in FIG. 3.

Still referring to FIG. 3, the body member is generally V-shaped and in the form of a segment of a circle. The pivot point 36 for the body member 28 is positioned generally at the center of the circle segment. As shown in FIG. 4, the arrow shaft supporting surface 32 is positioned generally at the periphery of the circle segment that forms the body member 28.

In the preferred embodiment, the body member 28 is formed of a resilient rubber-like material. The arrow shaft supporting surface 32 is generally arcuate and convex (see FIGS. 3 and 4) for frictional engagement with opposite sides of the shaft 34 of the arrow 22 (see, especially, FIG. 4). With this arrangement, the body member 28 will be understood as undergoing pivotal movement when the arrow 22 is propelled by the bowstring 30.

Figure 1:
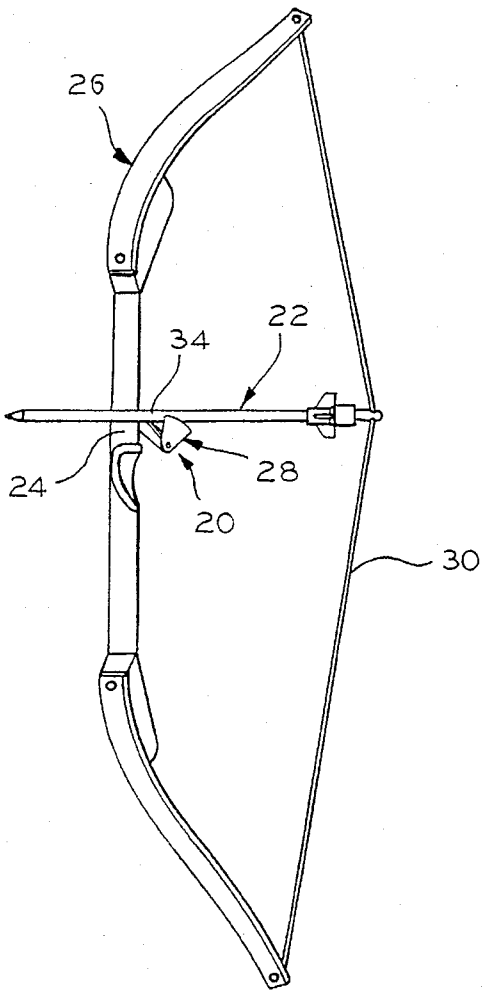
FIG. 1 is a side elevational view of a bow having an arrow rest assembly in accordance with the present invention.

As shown in FIGS. 2 and 3, the body member 28 has a leading edge defined by a forwardly facing surface 28*a* and a trailing edge defined by a rearwardly facing surface 28*b*. The leading edge and forwardly facing surface 28*a* will be understood as being generally vertically upwardly extending when the bow 26 is supported in a generally vertical position as shown in FIGS. 1 and 2. With reference to all of FIGS. 1–4, the shaft 34 of the arrow 22 is adapted to contact the arrow shaft supporting surface 32 at a point generally adjacent the leading edge and forwardly facing surface 28*a* of the body member 28.

Figure 5:
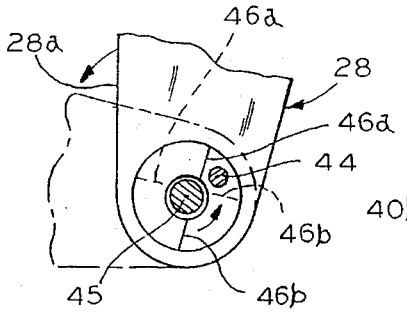
FIG. 5 is a cross-sectional view taken along the line 5—5 of FIG. 4.
Figure 6:
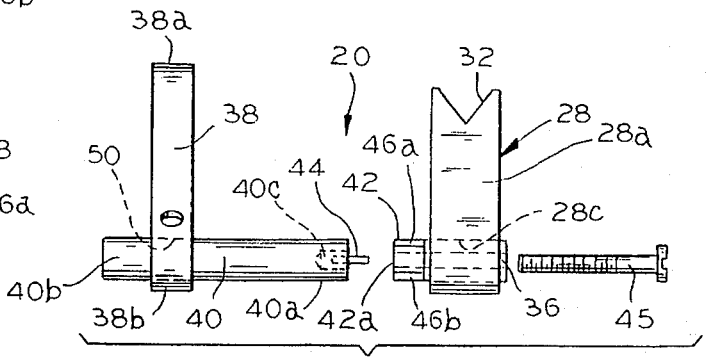
FIG. 6 is an exploded front elevational view of the arrow rest assembly in FIG. 4.

Referring now to FIGS. 4–6, the body member 28 will be seen as being mounted on an end 40*a* of the axial spacer shaft 40 so as to be in spaced relation to the axial spacer arm 38. This may be accomplished, by way of example, by utilizing a bushing 42 that extends through a hole 28*c* in the body member 28 generally concentric with the pivot point 36, together with a threaded fastener such as 45 that extends through the bushing 42 to cooperate with a threaded opening 40*c* in the end 40*a* of the axial spacer shaft 40. With this arrangement, there is very little frictional resistance to movement between the end 40*a* of the axial spacer shaft 40 and the bushing 42.

As shown in FIGS. 4–6, the arrow rest assembly 20 also includes stop means for limiting pivotal movement of the body member 28. The stop means includes a pin 44 and a pair of pin engagement surfaces 46*a* and 46*b* in angularly spaced relation where one of the pin 44 and pin engagement surfaces 46*a*, 46*b* is fixed and the other of the pin 44 and pin engagement surfaces 46*a*, 46*b* is movable with the body member 28 on the axial spacer shaft 40. In the illustrated embodiment, the pin 44 is fixed, and the pin engagement surfaces 46*a*, 46*b* are defined by a cutout of an extension 42*a* of the bushing 42 disposed in the hole 28*c* in the body member 28.

As for other details of the present invention, FIG. 3 illustrates a plurality of holes 48*a*, 48*b*, and 48*c* in the first end 38*a* of the axial spacer arm 38. These holes will be appreciated as being adapted to receive, e.g., a threaded fastener therethrough whereby the arrow rest assembly 20 can be threadably secured to the handle riser portion 24 of the bow 26. With this construction, the fastener may secure the axial spacer arm 38 to the handle riser portion 24 of the bow 26 in any of a plurality of different angles and distances from the bow 26 (see FIGS. 1 and 2).

Referring to FIGS. 3 and 4, the second end 38*b* of the axial spacer arm 38 has an opening 50 for receiving and retaining a second end 40*b* of the axial spacer shaft 40. The arrow rest assembly 20 also includes means associated with the second end 38*b* of the axial spacer arm 38 for securing the second end 40*b* of the axial spacer shaft 40 therewithin, including a diagonal slot 52 in the axial spacer arm 38 extending completely through to the opening 50. Still additionally, the securing means includes fastener means such as a threaded fastener 54 for compressing the slot to cause the axial spacer shaft 40 to be retained within the opening 50.

With the arrangement illustrated in FIGS. 1–6, the body member 28 will be understood to have pivotal movement imparted by reason of the frictional engagement of the convex arrow shaft supporting surface 32 with opposite sides of the shaft 34 of the arrow 22. The force imparted by the bowstring 30 to the arrow 22, coupled with the aforementioned frictional engagement, will cause the body member 28 to move forwardly, i.e., in the direction the arrow 22 is propelled. When the center of gravity 28*d* of the body member 28 passes over the pivot point 36 (see FIG. 3), the body member 28 can then "fall away" by reason of the gravitational force acting on the body member 28.

Referring now to FIGS. 7–10, an arrow rest assembly 120 is illustrated which is very nearly identical to the arrow rest assembly 20 illustrated in FIGS. 1–6. It includes a body member 128 having an arrow shaft supporting surface 132 and having a pivot point 136 spaced from the arrow shaft supporting surface 132. In addition, the arrow rest assembly 120 has an axial spacer arm 138, an axial spacer shaft 140, and a bushing 142.

As a slight difference, the bushing 142 is somewhat different in that it has a first relatively elongated portion 142*a* and a second relatively short portion 142*b*. The elongated portion 142*a* will be seen and understood as being of substantially equal diameter to the hole 128*c* through the body member 128, whereas the short portion 142*b* is of a larger diameter and carries a pin 144 that moves with the body member 128 as it pivots about the pivot point 136. As will also be appreciated, the pin engagement surfaces 146*a* and 146*b* comprise a cutout in the end 140*a* of the axial spacer shaft 140.

Figure 8:
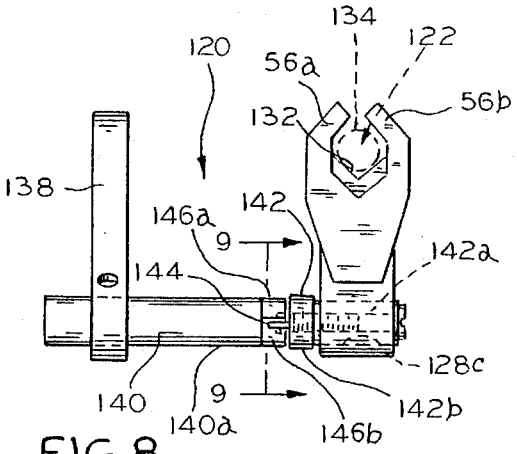
FIG. 8 is a front elevational view of the arrow rest assembly in FIG. 7.
Figure 7:
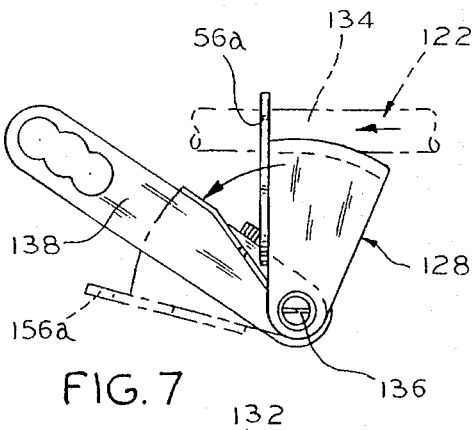
FIG. 7 is a side elevational view of another embodiment of the arrow rest assembly in accordance with the present invention.
Figure 9:
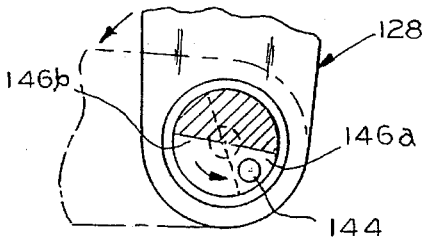
FIG. 9 is a cross-sectional view taken on the line 9—9 in FIG. 8.
Figure 10:
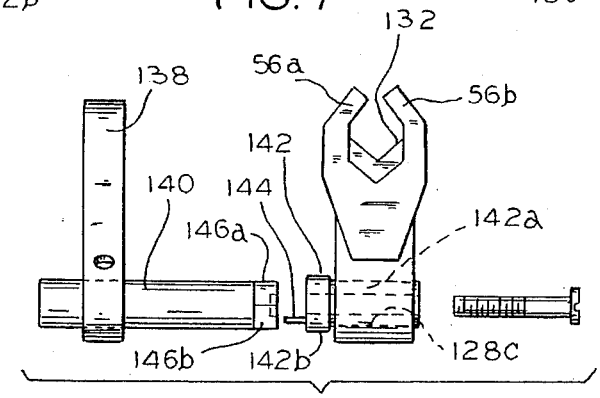
FIG. 10 is an exploded front elevational view of the arrow rest assembly in FIG. 8.

In other words, the embodiment illustrated in FIGS. 1–6 utilizes a fixed pin 44 and movable pin engagement surfaces 46*a* and 46*b*, whereas the embodiment illustrated in FIGS. 8–10 utilizes a movable pin 144 and fixed pin engagement surfaces 146*a* and 146*b* (see, in particular, FIGS. 9 and 10).

As for another important difference, the body member 128 includes resilient finger means associated with the leading edge and forwardly facing surface 128*a* thereof. The resilient finger means comprises a pair of fingers 56*a* and 56*b* generally located at the leading edge and forwardly facing surface 128*a* for releasably gripping the arrow shaft 134 when it is in frictional engagement with the convex arrow shaft supporting surface 132. When the arrow 122 is propelled by the bowstring 30, the body member 128 is caused to undergo pivotal movement forwardly as shown by the arrow in FIG. 7 which disengages the fingers 56*a* and 56*b* from the shaft 134 of the arrow 122 in order to avoid any interference with the flight thereof.

However, as will also be appreciated, the fingers 56*a* and 56*b* make it possible to retain the arrow 122 in the desired position relative to the arrow rest assembly 120 no matter what the orientation of the bow 26 until such time as the arrow 122 is propelled by releasing a retracted bowstring 30.

Figure 11:
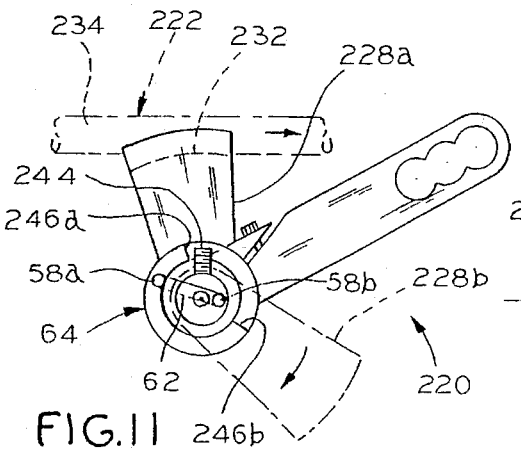
FIG. 11 is a side elevational view of yet another embodiment of the arrow rest assembly in accordance with the present invention.
Figure 12:
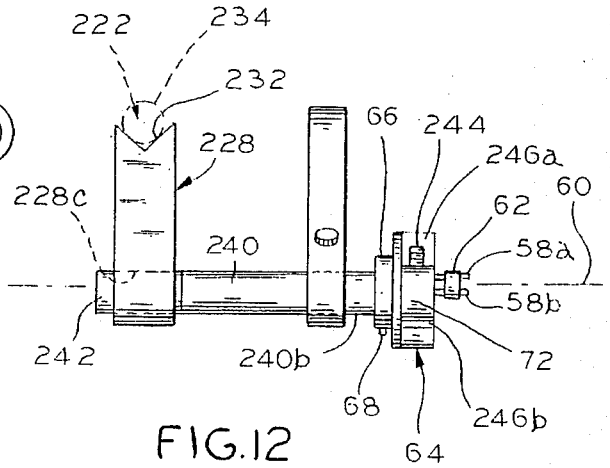
FIG. 12 is a front elevational view of the arrow rest assembly in FIG. 11.
Figure 13:
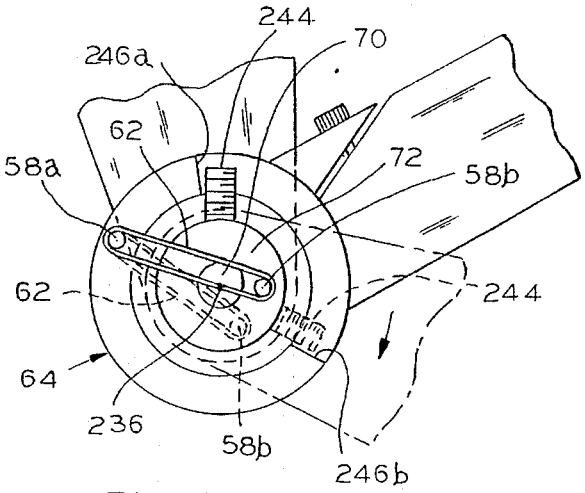
FIG. 13 is an enlarged partial side elevational view of the arrow rest assembly in FIG. 11.

Referring now to FIGS. 11–13, still another embodiment of arrow rest assembly 220 has been illustrated. It is also similar in many respects to the prior two embodiments, i.e., arrow rest assemblies 20 and 120 illustrated in FIGS. 1–6 and 7–10, respectively, but it also includes means for imparting an over center snap action when the body member 228 reaches a point generally intermediate the arrow supporting position and the arrow passage position. In other words, the movement of the body member 228 is assisted by other than gravity as the body member 228 undergoes pivotal movement about the pivot point 236.

Referring especially to FIG. 13, the over center snap action imparting means includes a pair of pins 58*a* and 58*b* extending parallel to but radially spaced from an axis 60 of the axial spacer shaft 240. One of the pins such as 58*a* is suitably fixed, and the other of the pins such as 58*b* is movable with the body member 228 on the axial spacer shaft 240. In addition, the over center snap action imparting means includes a resilient band 62 joining the pins 58*a* and 58*b*.

As best shown in FIG. 13, the pins 58*a* and 58*b* are located along a line on one side of the axis 60 in the arrow supporting position and along a line on the other side of the axis 60 in the arrow passage position. It will be appreciated that the arrow supporting position for the body member 228 is shown in solid lines in FIGS. 11 and 13 with the pins 58*a* and 58*b* then being located along a line "above" the axis 60, whereas the body member 228 is shown in the arrow passage position in broken lines in FIGS. 11 and 13 with the pins 58*a* and 58*b* then being located along a line "below" the axis 60. As will be appreciated, the over center snap action imparting means renders the body member 228 entirely stable in either the arrow supporting position or the arrow passage position, but it is unstable at positions therebetween.

As the bowstring 30 propels the arrow 222 forwardly (see FIG. 11), the frictional engagement of the arrow shaft supporting surface 232 with the shaft 234 of the arrow 222 causes the body member 228 to begin its pivotal movement. The resilient band 62 causes the body member to quickly accelerate to the arrow passage position just after the line between the pins 58*a* and 58*b* passes the axis 60. When this occurs, the resilient band 62 applies a force that accelerates the movement of the body member 228 out of the flight path of the arrow 222.

As illustrated in FIGS. 11–13, this over center snap action imparting means is located at the second end 240*b* of the axial spacer shaft 240 remote from the body member 228. It may advantageously comprise a generally cylindrical disc generally designated 64 that has a collar 66 adapted to slide on the axial spacer shaft 240 and be secured thereto by means of a set screw 68. As shown in FIGS. 11–13, the generally cylindrical disc 64 has a cutout defining a pair of pin engagement surfaces 246*a* and 246*b*.

As will be appreciated, the cylindrical disc 64 is fixed relative to the shaft 240. There is, however, an axle 70 that extends through the axial spacer shaft 240 and which is secured to a bushing 242 in the hole 228*c* in the body member 228 and is also secured to a cylindrical enlargement 72 on the other end thereof. As best shown in FIG. 13, the cylindrical enlargement 72 carries a pin 244 that moves with the body member 228 between the pin engagement surfaces 246*a* and 246*b*.

By reason of the securement of the cylindrical disc 64 with a set screw 68, there is some adjustability that is possible in terms of the movement of the body member 228. It is, thus, possible to adjust the starting position of the leading edge and forwardly facing surface 228*a* and, thus, the ending position for the trailing edge and rearwardly facing surface 228*b*. In addition, this adjustment makes it possible to vary the force that is imparted by the over center snap action imparting means.

Figure 14:
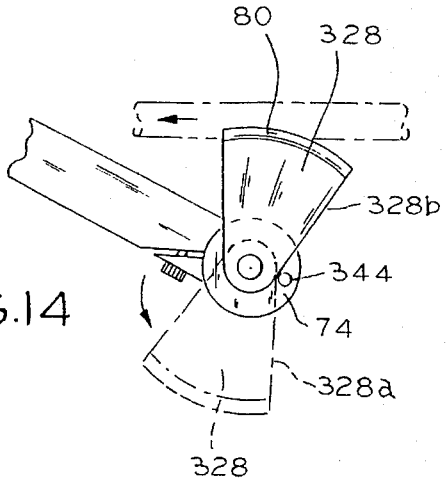
FIG. 14 is a side elevational view of still another embodiment of the arrow rest assembly in accordance with the present invention.
Figure 15:
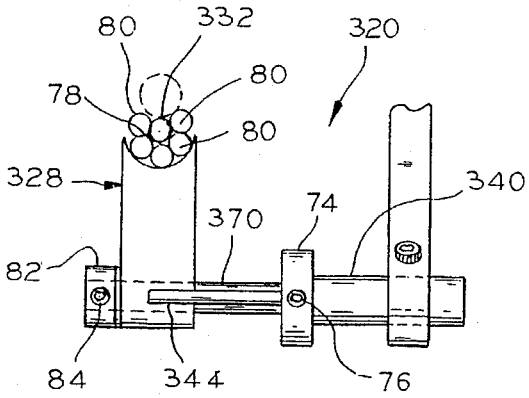
FIG. 15 is a front elevational view of the arrow rest assembly in FIG. 14.
Figure 17:
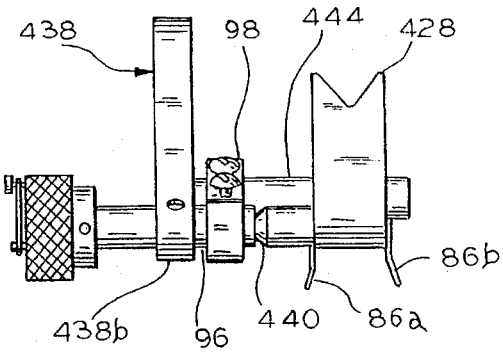
FIG. 17 is a front elevational view of the arrow rest assembly in FIG. 16.
Figure 16:
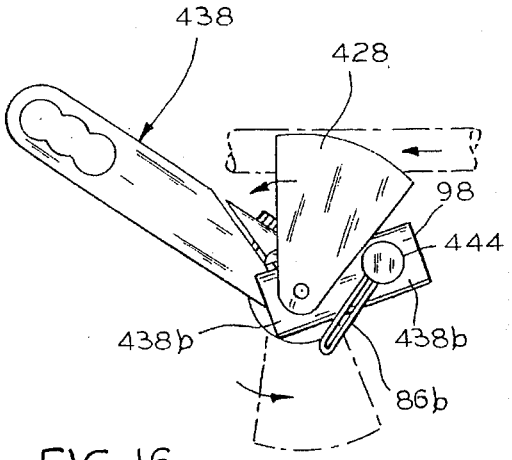
FIG. 16 is a side elevational view of yet another embodiment of the arrow rest assembly in accordance with the present invention.
Figure 18:
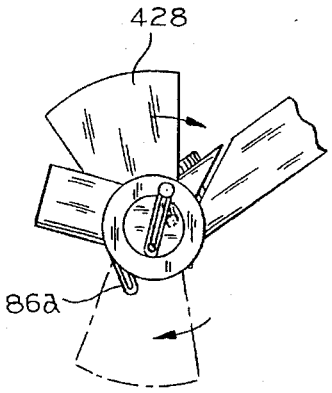
FIG. 18 is a side elevational view of the arrow rest assembly in FIG. 16 from the side opposite that illustrated in FIG. 16.
Figure 19:
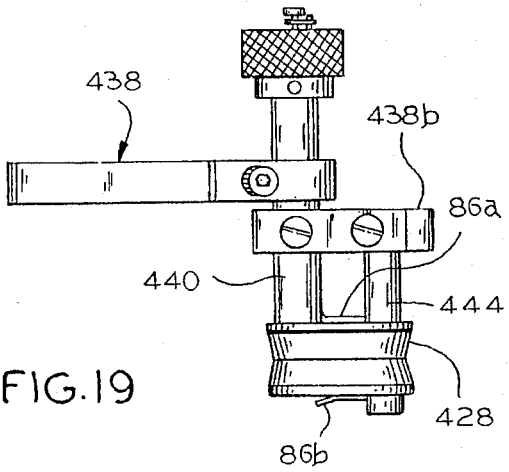
FIG. 19 is a top plan view of the arrow rest assembly FIG. 16.

Referring now to FIGS. 14 and 15, still another embodiment of arrow rest assembly 320 has been illustrated. It is quite similar to the embodiment illustrated in FIGS. 1–6, with the exception of the stop means. In addition, the arrow shaft supporting surface 332 is somewhat different in construction.

More specifically, the stop means once again comprises a pin 344 that is fixed in relation to movement of the body member 328. This pin 344 is supported in an adjustable, but fixed, position by means of a collar 74 that is secured on the axial spacer shaft 340 by means of a set screw 76. Unlike the earlier embodiments, the pin engagement surfaces comprise the actual leading and trailing edges, i.e., the forwardly and rearwardly facing surfaces 328*a* and 328*b*.

In other words, the trailing edge or rearwardly facing surface 328*b* is adapted to rest on the pin 344 in the arrow supporting position, and the leading edge or forwardly facing surface 328*a* is adapted to rest on the pin 344 in the arrow passage position (see FIG. 14).

As a further difference, the body member 328 has a first convex surface 78 that carries a plurality of elongated resilient tubular elements 80 which together define the convex arrow supporting surface 332. The tubular elements 80 may suitably be solid resilient tubes that are laid in the intermediate convex surface 78 and secured therein in an arcuate arrangement substantially as shown in FIG. 14. With this arrangement, the frictional engagement and shock absorption is noticeably enhanced.

Finally, the embodiment illustrated in FIGS. 14 and 15 includes an extended axle 370 carrying the body member 328 in a manner permitting horizontal adjustment toward and away from the handle riser portion 24 of the bow 26, and a collar 82 is provided to secure the body member 328 on the axle 370 by means of fastening the collar 82 to the axle 370 with a set screw 84.

In still another embodiment illustrated in FIGS. 16–19, the stop means includes an axial stop arm 444 supported by the second end 438*b* of the axial spacer arm 438 to extend perpendicular thereto. The axial stop arm 444 is disposed generally parallel to the axial spacer shaft 440 and extends to a point where the body member 428 in the arrow supporting position (solid lines) is in engagement therewith. Further, the stop means may include a pair of spring fingers 86*a* and 86*b* extending generally perpendicularly from the axial stop arm 444 for limiting pivotal movement by releasably gripping the body member 428 at the arrow passage position (broken lines) thereof.

Figure 21:
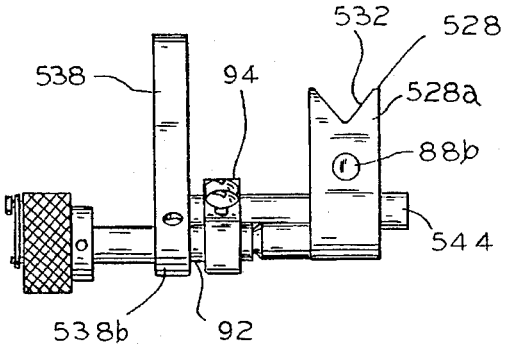
FIG. 21 is a front elevational view of the arrow rest assembly in FIG. 20.
Figure 20:
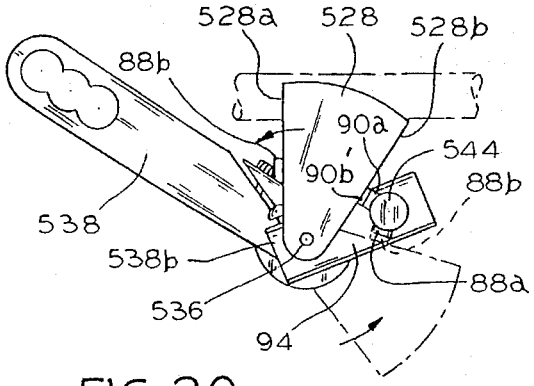
FIG. 20 is a side elevational view of still another embodiment of the arrow rest assembly in accordance with the present invention.

With reference to the embodiment illustrated in FIGS. 20 and 21, the body member 528 is generally V-shaped in the form of a segment of a circle having a forwardly facing surface 528*a* and a rearwardly facing surface 528*b* such that the pivot point 536 for the body member 528 is positioned generally at the center of the circle and the arrow shaft supporting surface 532 is positioned generally at the periphery of the circle. With this arrangement, the stop means may further include magnetic means including attracting magnets 88*a* and 88*b* operatively associated with the axial stop arm 544 and the forwardly facing surface 528*a* of the body member 528 for limiting pivotal movement by magnetically maintaining the body member 528 in the arrow passage position (broken lines) after the body member 528 has pivoted from the arrow supporting position (solid lines). Similarly, the stop means may still further include magnetic means including attracting magnets 90*a* and 90*b* operatively associated with the axial stop arm 544 and the rearwardly facing surface 528*b* of the body member 528 for limiting pivotal movement by magnetically maintaining the body member 528 in the arrow supporting position (solid lines) until the body member 528 is caused to pivot from the arrow supporting position (solid lines).

In the last-mentioned embodiment, the second end 538*b* of the axial spacer arm 538 includes a shaft 92 extending generally perpendicular thereto supporting a supplemental spacer arm 94 in adjacent relation whereby the axial spacer shaft 540 and the axial stop arm 544 are supported by and extend perpendicular to the supplemental spacer arm 94 in spaced parallel relation. As will also be appreciated, the embodiment illustrated in FIGS. 16–19 may also be formed with the second end 438*b* of the axial spacer arm 438 having a shaft 96 extending generally perpendicular thereto supporting a supplemental spacer arm 98 in adjacent relation whereby the axial spacer shaft 440 and the axial stop arm 444 are supported by and extend perpendicular to the supplemental spacer arm 98 in spaced relation.

While in the foregoing there have been set forth preferred embodiments of the invention, it will be appreciated that the details herein given may be varied by those skilled in the art without in any way departing from the true spirit and scope of the appended claims.

We claim:

1. An arrow rest assembly for use on a bow which comprises a handle riser portion, upper and lower limbs, and a bow string, which generally define a bow plane in which an arrow is released, said handle riser portion including a portion offset laterally from said bow plane to provide clearance for arrow release, said arrow rest assembly comprising:

means for supporting an arrow having fletching laterally spaced from said offset portion of said handle riser portion of said bow, said arrow supporting means including a body member disposed in said bow plane, said body member having a surface for supporting and serving as a rest for a shaft of said arrow in said bow plane;

means for mounting said body member to said handle riser portion of said bow so as to be in laterally spaced relation thereto, said body member having a pivot point spaced from said shaft supporting surface and said pivot point being in said bow plane, said mounting means being associated with said body member generally at said pivot point;

said mounting means accommodating pivotal movement of said body member within said bow plane, said pivotal movement of said body member being about said pivot point in spaced relation to and unrestricted by said bow from an arrow supporting and rest position to an arrow passage position, both said body member in said arrow passage position and said bow being entirely out of the path of travel of said arrow including said fletching.

2. The arrow rest assembly of claim 1 wherein said body member is generally V-shaped in the form of a segment of a circle, said pivot point for said body member being positioned generally at the center of said circle, and said arrow shaft supporting surface being positioned generally at the periphery of said circle.

3. The arrow rest assembly of claim 1 wherein said mounting means includes an arm having a first end adapted to be secured to said handle riser portion of said bow, said body member being pivotally mounted on a shaft supported by a second end of said arm to extend perpendicular to said arm at a point remote from said first end.

4. The arrow rest assembly of claim 1 including first stop means for limiting pivotal movement of said body member at said arrow supporting position of said body member and also including second stop means for limiting pivotal movement of said body member at said arrow passage position of said body member.

5. The arrow rest assembly of claim 1 including means for imparting over center snap action when said body member reaches a point generally intermediate said arrow supporting position and said arrow passage position as said body member undergoes pivotal movement about said pivot point.

6. An arrow rest assembly for use on a bow which comprises a handle riser portion, upper and lower limbs, and a bow string, which generally define a bow plane in which an arrow is released, said handle riser portion including a portion offset laterally from said bow plane to provide clearance for arrow release, said arrow rest assembly comprising:

means for supporting an arrow having fletching laterally spaced from said offset portion of said handle riser portion of said bow, said arrow supporting means including a body member disposed in said bow plane, said body member having a surface for supporting and serving as a rest for a shaft of said arrow in said bow plane;

means for mounting said body member to said handle riser portion of said bow so as to be in laterally spaced relation thereto, said body member having a pivot point spaced from said shaft supporting surface and said pivot point being in said bow plane, said mounting means being associated with said body member generally at said pivot point;

said mounting means accommodating pivotal movement of said body member within said bow plane, said pivotal movement of said body member being about said pivot point in spaced relation to and unrestricted by said bow from an arrow supporting and rest position to an arrow passage position, both said body member in said arrow passage position and said bow being entirely out of the path of travel of said arrow including said fletching;

said mounting means including an axial spacer arm having a first end to be secured to said handle riser portion of said bow and a second end remote therefrom, said body member being mounted for pivotal movement on an axial spacer shaft supported by said second end of said arm to extend perpendicular thereto; and stop means for limiting pivotal movement of said body member at said arrow supporting position of said body member and also for limiting pivotal movement of said body member at said arrow passage position of said body member.

7. The arrow rest assembly of claim 6 wherein said body member is generally V-shaped in the form of a segment of a circle, said pivot point for said body member being positioned generally at the center of said circle, and said arrow shaft supporting surface being positioned generally at the periphery of said circle.

8. The arrow rest assembly of claim 6 including means for imparting over center snap action when said body member reaches a point generally intermediate said arrow supporting position and said arrow passage position as said body member undergoes pivotal movement about said pivot point.

9. The arrow rest assembly of claim 6 wherein said body member is formed of a rubber material, said arrow shaft supporting surface being generally arcuate and convex for frictional engagement with said shaft of said arrow, said body member undergoing pivotal movement when said arrow is propelled by said bowstring.

10. The arrow rest assembly of claim 6 wherein said body member has a leading edge that is generally vertically upwardly extending in said arrow supporting position, said shaft of said arrow being adapted to contact said arrow shaft supporting surface at a point generally adjacent said leading edge of said body member.

11. The arrow rest assembly of claim 6 including a plurality of holes in said first end of said axial spacer arm for receiving a fastener therethrough, said fastener securing said axial spacer arm to said handle riser portion of said bow in any of a plurality of different angles and distances from said bow.

12. The arrow rest assembly of claim 6 wherein said second end of said axial spacer arm has an opening for receiving and retaining an end of said axial spacer shaft, and further including means associated with said second end of said axial spacer arm for securing said end of said axial spacer shaft therewithin.

13. The arrow rest assembly of claim 6 wherein said body member is mounted on an end of said axial spacer shaft in spaced relation to said axial spacer arm, said body member including resilient finger means for releasably gripping said arrow shaft when said arrow shaft is on said arrow shaft supporting surface thereof.

14. The arrow rest assembly of claim 6 wherein said stop means includes an axial stop arm supported by said second end of said axial spacer arm to extend perpendicular thereto, said axial stop arm being disposed generally parallel to said axial spacer shaft and extending to a point where said body member in said arrow supporting position is in engagement therewith.

15. The arrow rest assembly of claim 14 wherein said stop means further includes a pair of fingers extending from said axial stop arm for limiting pivotal movement by releasably gripping said body member, said fingers extending generally perpendicular to said axial stop arm for gripping said body member at said arrow passage position thereof.

16. The arrow rest assembly of claim 14 wherein said body member is generally V-shaped in the form of a segment of a circle having a forwardly facing surface and a rearwardly facing surface, said pivot point for said body member being positioned generally at the center of said circle and said arrow shaft supporting surface being positioned generally at the periphery of said circle.

17. The arrow rest assembly of claim 16 wherein said stop means further includes magnetic means operatively associated with said axial stop arm and said forwardly facing surface of said body member for limiting pivotal movement by magnetically maintaining said body member in said arrow passage position after said body member has pivoted from said arrow supporting position.

18. The arrow rest assembly of claim 16 wherein said stop means further includes magnetic means operatively associated with said axial stop arm and said rearwardly facing surface of said body member for limiting pivotal movement by magnetically maintaining said body member in said arrow supporting position until said body member is caused to pivot from said arrow supporting position.

19. The arrow rest assembly of claim 14 wherein said second end of said axial spacer arm includes a shaft extending generally perpendicular thereto supporting a supplemental spacer arm in adjacent relation, said axial spacer shaft and said axial stop arm being supported by and extending generally perpendicular to said supplemental spacer arm in spaced parallel relation.

20. An arrow rest assembly for use on a bow which comprises a handle riser portion, upper and lower limbs, and a bow string, which generally define a bow plane in which an arrow is released, said handle riser portion including a portion offset laterally from said bow plane to provide clearance for arrow release, said arrow rest assembly comprising:

means for supporting an arrow having fletching laterally spaced from said offset portion of said handle riser portion of said bow, said arrow supporting means including a body member disposed in said bow plane, said body member having a surface for supporting and serving as a rest for a shaft of said arrow in said bow plane;

means for mounting said body member to said handle riser portion of said bow so as to be in laterally spaced relation thereto, said body member having a pivot point spaced from said shaft supporting surface and said pivot point being in said bow plane, said mounting means being associated with said body member generally at said pivot point;

said body member being generally V-shaped and in the form of a segment of a circle, said pivot point for said body member being positioned generally at the center of said circle segment, and said arrow shaft supporting surface being positioned generally at the periphery of said circle segment;

said mounting means accommodating pivotal movement of said body member within said bow plane, said pivotal movement of said body member being about said pivot point in spaced relation to and unrestricted by said bow from an arrow supporting and rest position to an arrow passage position, both said body member in said arrow passage position and said bow being entirely out of the path of travel of said arrow including said fletching;

said body member being formed of a resilient rubber-like material, said arrow shaft supporting surface being generally arcuate and convex for frictional engagement with opposite sides of said shaft of said arrow, said body member undergoing pivotal movement when said arrow is propelled by said bowstring;

said body member having a leading edge that is generally vertically upwardly extending when said bow is supported in a generally vertical position, said shaft of said arrow being adapted to contact said arrow shaft supporting surface at a point generally adjacent said leading edge of said body member;

said mounting means including an axial spacer arm having a first end to be secured to said handle riser portion of said bow and a second end remote therefrom, said body member being mounted for pivotal movement on an axial spacer shaft supported by said second end of said arm to extend perpendicular thereto;

said body member being mounted on an end of said axial spacer shaft so as to be in spaced relation to said axial spacer arm; and stop means for limiting pivotal movement of said body member at said arrow supporting position of said body member and also for limiting pivotal movement of said body member at said arrow passage position of said body member.

21. The arrow rest assembly of claim 20 including means for imparting over center snap action when said body member reaches a point generally intermediate said arrow supporting position and said arrow passage position as said body member undergoes pivotal movement about said pivot point.

22. The arrow rest assembly of claim 21 wherein said over center snap action imparting means includes a pair of pins extending parallel to but radially spaced from an axis of said axial spacer shaft with one of said pins being fixed and the other of said pins being movable with said body member on said axial spacer shaft, said over center snap action imparting means also including a resilient band joining said pins and said pins being located along a line on one side of said axis in said arrow supporting position and along a line on the other side of said axis in said arrow passage position.

23. The arrow rest assembly of claim 20 including a plurality of holes in said first end of said axial spacer arm for receiving a fastener therethrough, said fastener securing said axial spacer arm to said handle riser portion of said bow in any of a plurality of different angles and distances from said bow.

24. The arrow rest assembly of claim 20 wherein said second end of said axial spacer arm has an opening for receiving and retaining a second end of said axial spacer shaft, and further including means associated with said second end of said axial spacer arm for securing said second end of said axial spacer shaft therewithin.

25. The arrow rest assembly of claim 24 wherein said securing means includes a diagonal slot in said axial spacer arm extending completely through to said opening, said securing means further including fastener means for compressing said slot to cause said axial spacer shaft to be retained within said opening.

26. The arrow rest assembly of claim 20 wherein said body member includes resilient finger means including a pair of fingers generally located at said leading edge for releasably gripping said arrow shaft when said arrow shaft is in frictional engagement with said convex arrow shaft supporting surface.

27. The arrow rest assembly of claim 20 wherein said stop means includes a pin and a pair of pin engagement surfaces in angularly spaced relation with one of said pin and pin engagement surfaces being fixed and the other of said pin and pin engagement surfaces being movable with said body member on said axial spacer shaft.

* * * * *